United States Patent [19]

Tricca

[11] 4,293,173

[45] Oct. 6, 1981

[54] ELECTRICAL OUTLET INSULATION SYSTEM

[75] Inventor: Raymond A. Tricca, Farmington Hills, Mich.

[73] Assignee: Armstrong Cork Company, Lancaster, Pa.

[21] Appl. No.: 1,732

[22] Filed: Jan. 8, 1979

Related U.S. Application Data

[63] Continuation-in-part of Ser. No. 878,412, Feb. 16, 1978, abandoned.

[51] Int. Cl.[3] ..... H01R 13/44

[52] U.S. Cl. ..... 339/38; 174/67; 339/94 R

[58] Field of Search ..... 339/38, 94 R, 94 M; 174/66, 67; 220/241, 242

[56] References Cited

U.S. PATENT DOCUMENTS

| | | | |
|---|---|---|---|
| 794,140 | 7/1905 | Costa | 339/38 |
| 1,713,101 | 5/1929 | Starett | 174/66 |
| 2,619,515 | 11/1952 | Doane | 339/94 R |
| 2,641,627 | 6/1953 | Lewis | 174/67 |
| 2,710,382 | 6/1955 | Fitzpatrick et al. | 339/40 |
| 2,997,520 | 8/1961 | Kinsman | 174/67 |
| 3,028,467 | 4/1962 | Hubbell | 200/168 |
| 3,041,574 | 6/1962 | Cornell, Jr. | 339/94 R |
| 3,140,344 | 7/1964 | Slater et al. | 174/67 |
| 3,201,740 | 8/1965 | Rubens | 339/40 |
| 3,392,228 | 7/1968 | Zerwes | 174/52 |
| 3,678,441 | 7/1972 | Upstone et al. | 339/94 R |
| 3,845,234 | 10/1974 | Brenner | 174/67 |

FOREIGN PATENT DOCUMENTS

| | | | |
|---|---|---|---|
| 935829 | 9/1963 | United Kingdom | 339/38 |

*Primary Examiner*—Neil Abrams

[57] ABSTRACT

A thermal insulation system for electrical outlets installed against the outside walls of buildings. A large plate of special thermal insulation is secured behind the faceplate of the outlet. Other smaller plates of thermal insulation are placed over the receptacles of the electrical outlets. Dummy plugs are used to seal the slots of the receptacles and hold the small insulation plates in position.

3 Claims, 4 Drawing Figures

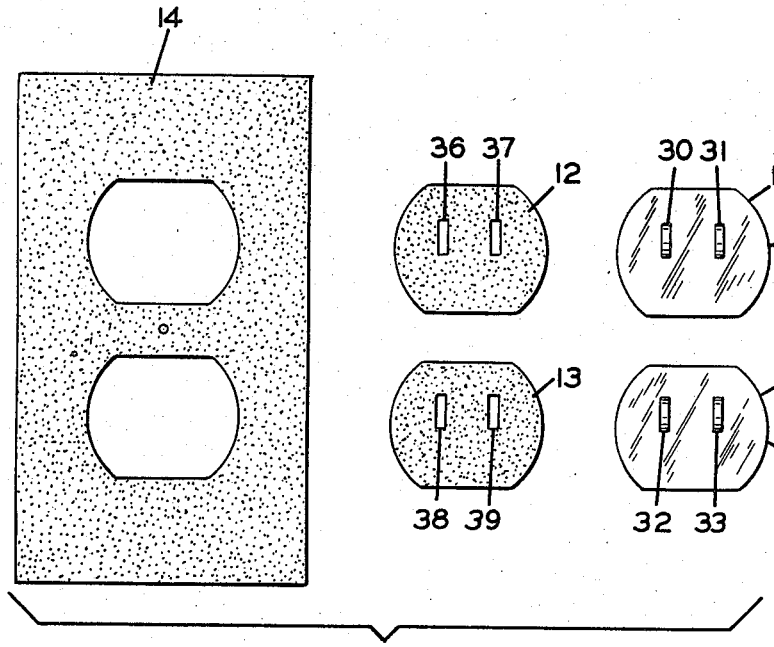
FIG. 1
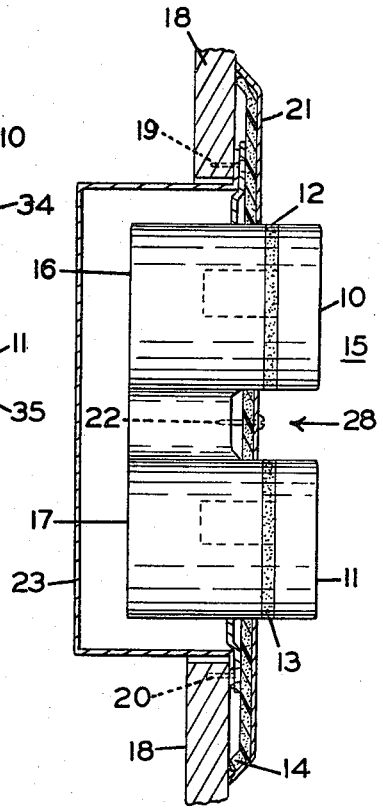
FIG. 2
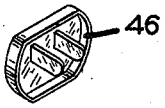
FIG. 4
FIG. 3
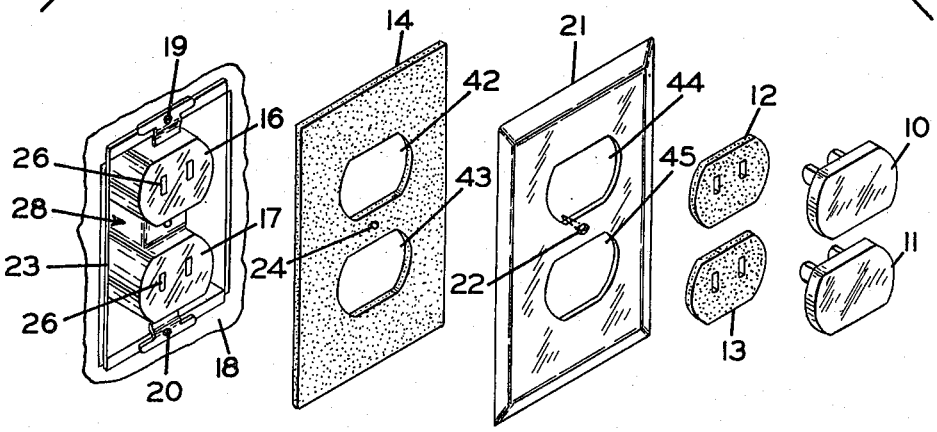

ELECTRICAL OUTLET INSULATION SYSTEM

CROSS REFERENCE TO RELATED APPLICATIONS

This application is a continuation-in-part of U.S. Application Ser. No. 878,412, filed Feb. 16, 1978, now abandoned, in the name of Raymond A. Tricca and entitled, "Electrical Outlet Insulation System."

BACKGROUND OF THE INVENTION

The present invention relates to thermal insulation systems for buildings and, more particularly, to insulation systems for electrical outlet assemblies in exterior walls.

An important source of heat loss in conventional building structures is air infiltration through gaps and cracks in the walls and in the framing around windows and doors. It has been empirically established that approximately 20% of all air infiltration in residential buildings is attributable to losses through electrical outlets on the inside of exterior walls. Electrical outlet assemblies, including the electrical boxes in which they are disposed, comprise a gap in the insulation system of conventional buildings through which heated air is readily lost from the building at the same time that cold air is admitted into the structure. Furthermore, these assemblies form a path for large heat conduction losses through the wall and a means through which moisture may permeate into wall insulation materials. In order to improve the thermal efficiency of residential buildings and save energy, the provision of an insulation system for electrical outlets is a logical expedient.

Prior patents, i.e., U.S. Pat. No. 1,713,101, have disclosed the use of plates of electrical insulation disposed behind the faceplate of an electrical switch. However, these insulation plates have been formed of hard rubber or bakelite materials, which materials, although they possess good electrical insulation properties, are poor thermal insulators. Furthermore, these materials do not have the properties of compressibility and resilience necessary to properly seal the electrical switch box against air infiltration. Other patents, i.e., U.S. Pat. No. 3,028,467, have disclosed the use of sealing cover plates in conjunction with switch boxes. However, these plates have not been disposed in front of the switch faceplate, they have not been designed to provide a barrier to thermal conduction, and their application has necessarily been limited to electrical switches which do not have electrical plug slots. Another series of patents, i.e., U.S. Pat. Nos. 2,641,627; 2,710,382; 3,201,740; and 3,845,234, have disclosed cover plates for the electrical plug slots of electrical receptacles to protect against electrical shock. However, these plates have generally been of limited size sufficient only to cover the slots and the electrical socket elements themselves; and, consequently, they have been inadequate to provide an effective barrier against thermal conduction or seal the outlet assembly against air infiltration.

SUMMARY OF THE INVENTION

It is a principle object of the present invention to provide an effective thermal insulation system for electrical outlets in exterior walls.

It is another object of the present invention to provide a thermal insulation system for electrical outlets which diminishes heat conduction through the outlet, prevents air infiltration through the outlet, and provides a barrier against moisture permeation into the wall insulation.

It is a further object of the present invention to provide a thermal insulation system for electrical outlets which does not distract from the appearance of the wall outlet and is otherwise well suited to the purposes for which the same is intended.

Accordingly, the present invention comprises a thermal insulation system for electrical wall outlets of the type wherein a receptacle assembly is covered by a faceplate and positioned within an electrical box. The receptacle assembly is the device to which the electrical wiring is attached, and the receptacle assembly is normally provided with two raised sockets, each having a pair of slots into which plugs are inserted. A plate of thermal insulating material is secured behind the faceplate, but flush with the inside surface of the faceplate. This plate of insulating material is made large enough to extend fully to the edges of the faceplate and form a seal around these edges against air infiltration in addition to preventing heat conduction through the outlet. The plate of insulating material has two apertures therein, and these fit snugly around the raised sockets of the receptacle assembly. Other plates of thermal insulation are positioned over the surfaces of the raised sockets, and these plates are provided with slots corresponding to the electrical slots in the raised sockets. Dummy plugs are used to seal the slots in the raised socket and hold the plates of thermal insulation in position against the raised sockets. Thereby, the electrical receptacle assemblies are also protected against heat conduction and sealed against air infiltration.

BRIEF DESCRIPTION OF THE DRAWINGS

FIG. 1 is a front view of the components of the present invention.

FIG. 2 is a cross-sectional view of a conventional wall outlet with the present invention installed thereon.

FIG. 3 is a perspective view of the components of the present invention in coordination positions with respect to the components of the conventional wall outlet.

FIG. 4 is a perspective view of a particular type of dummy plug construction without the plate of thermal insulation inserted therein.

DESCRIPTION OF THE PREFERRED EMBODIMENT

Referring now to the drawings, wherein like reference characters refer to like or corresponding parts throughout the several views, FIG. 1 shows a front view of the components of the present invention comprising two dummy plugs 10 and 11, two raised socket covering small insulation plates 12 and 13, and one faceplate backing large insulating plate 14. FIG. 2 shows a cross section of a conventional wall outlet comprising duplex receptacle assembly 28 including raised sockets 16 and 17 secured to box 23 by screws 19 and 20, faceplate 21 secured to the receptacle assembly 28 by screw 22, and an electrical box 23. The components of the present invention, including plugs 10 and 11, small plates 12 and 13, and large plate 14, are shown installed on the wall outlet of FIG. 2 in operational condition. All of the components illustrated in FIGS. 1 and 2 are shown in coordinate positions in an expanded perspective view in FIG. 3.

Examining the components of the present invention in greater detail, plugs 10 and 11 include, respectively, blades 30 and 31 and blades 32 and 33, which may be constructed of any suitable rigid nonelectrically conductive material such as polyethylene or polypropylene. The dummy plugs include plug bodies 34 and 35 which are molded integral with the blades and are sufficient strength to hold the blades in position. The blades 30, 31, 32, and 33 are secured in the plug bodies 34 and 35 so that the blades may readily be inserted in the electrical slots of a conventional electrical receptacle assembly. Covering plates 12 and 13 for the raised sockets are shaped to cover the exterior front faces of the raised sockets 16 and 17 and include slot holes 36, 37, and 38, 39 located so as to be positioned directly over the slots 26 in the face of the raised socket they are designed to cover when the plates are in position. The small covering plates 12 and 13 for the raised sockets are approximately $\frac{1}{8}$ inch thick and may be constructed of any suitable thermal insulating material having a low thermal conductivity and good compressibility and resilience; although they are preferably constructed of a resilient closed cell foam material such as Armaflex® foam manufactured by Armstrong Cork Company. This material is a nitrile-PVC blend foam having a thermal conductivity of 0.27 Btu.-in./hr.-ft.$^2$°F., with a density of 5.5 lb./cu. ft. and good fire retardant properties. Faceplate backing insulation plate 14 is shaped to fit snugly behind the faceplate 21, matching the design of the faceplate and extending to the edges of the faceplate along the exterior perimeter, and also extending fully or slightly beyond the edges of the faceplate along its interior perimeter. A small hole 24 is provided in the center of the backing plate 14 through which faceplate screw 22 may extend. The large faceplate insulation backing plate is approximately $\frac{1}{8}$ inch thick and may be constructed of any suitable thermal insulating material having a low thermal conductivity and good compressibility and resilience, and may be particularly the above-described Armstrong Armaflex® material.

The faceplate 21 is provided with two apertures 40 and 41 which correspond in shape to the raised sockets 16 and 17. The insulation backing plate 14 has also two apertures 42 and 43 which correspond to the raised sockets 15 and 17. The size of the apertures 42 and 43 are slightly smaller than the size of the raised sockets so that the backing plate 14 fits snugly around the sides of the raised sockets and forms a good airtight fit there. In addition, the fastening of the faceplate 21 in position with the insulation backing plate 14 therebehind will permit the edges of the apertures 44 and 45 of the faceplate 21 to compress the edges of the apertures 42 and 43 against the body of the receptacle to form a snug fit which will prevent air infiltration around the edges of the raised sockets. At the same time, the edge of the faceplate will compress the edge regions of the insulating backing 14 against the wall 18 to form a snug fit there to prevent air infiltration at that point.

As illustrated in FIG. 3, the present invention is assembled for operation with the components of a wall outlet by locating the faceplate backing plate 14, a first large plate of thermal insulation, behind the faceplate 21 and over the electrical box 23 and associate elements. The receptacle cover plates 12 and 13, which are second smaller plates of thermal insulation, are placed over the front faces of the raised sockets 16 and 17. Dummy plugs 10 and 11 are disposed in front of the receptacle cover plate 12 and 13. As illustrated in FIG. 2, when fully assembled, the blades 30, 31, 32, and 33 of the dummy plugs 10 and 11 extend through the slots 36, 37, 38, and 39 in the receptacle cover plates 12 and 13 into the electrical slots 26 in the raised sockets 16 and 17, thereby securing the receptacle cover plates against the front faces of the receptacles. The faceplate 21 is connected to the duplex receptacle assembly 28 by screw 22. The faceplate backing plate is secured between the faceplate 21 and the wall 18, duplex receptacle assembly 28 and the electrical box 23.

In operation, the faceplate backing plate 14 provides thermal insulation against heat conduction through the faceplate 21 of the wall outlet 15. Further, the backing plate 14 on account of its compressible and resilient nature seals the wall outlet 15 against air infiltration between the faceplate 21 and the wall 18, and the faceplate and the duplex receptacle assembly 28. The receptacle cover plates 12 and 13 provide thermal insulation against heat conduction through the raised sockets 16 and 17 of the wall outlet 15. Further, the receptacle cover plates 12 and 13 help seal the wall outlet 15 against air infiltration through the slots of the raised sockets 16 and 17. The blades 30, 31, 32, and 33 of the plugs 10 and 11 also help seal the receptacle against air infiltration by fitting into the electrical slots 26 of the raised sockets 16 and 17 and closing that path for air infiltration. Therefore, there has been provided a thermal insulation system for electrical wall outlets which effectively limits heat conduction and air infiltration through the wall outlets. Further, if Armaflex® foam is used for the backing plates and cover plates on account of its low water vapor permeability of 0.10 perm—in.—wet cup, it also helps seal the wall outlet and protect any interior wall insulation from moisture permeation.

Alternatively, for the purposes of electrical receptacles having a ground slot, plugs may be provided having a third blade disposed to fit into this ground slot and helping to seal it against air infiltration. An additional slot would also be provided in the receptacle cover plates to accommodate this third blade.

FIG. 4 shows a modification of the dummy plug wherein it is provided with a ridge 46 on the side of the dummy plug containing the blades. This ridge around the edge of the plug backing provides a recess in the backing on the side of the backing containing the blades. The cover plate 12 is sized to fit within this recess. This then provides a dummy plug which is now capable of being readily grasped by the hand without the fingers, as they grasp the dummy plug, damaging the cover plate 12. In addition, this provides a better means of holding the cover plate 12 against the face of the raised socket to seal the face of the raised socket to air infiltration.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. In an electrical wall outlet of the type wherein there is at least one electrical receptacle having a raised socket with slots therein adapted for receiving the blades of an appliance plug, a faceplate secured to the electrical receptacle and said raised socket extends through said faceplate, and said electrical receptacle and faceplate are mounted on an electrical box which is positioned within a wall, the improvement comprising:

(a) a first large plate of thermal insulation having a compressible and resilient character secured behind said faceplate, between said faceplate and said wall, said large plate of thermal insulation extending to the exterior edges of said faceplate and having at least one aperture therein which has the edges thereof engaging the sides of the raised socket of the electrical receptacle, said outer edges of said faceplate forming a seal around the outer edges of said faceplate between said faceplate and said wall, said edges of said aperture snugly fit around the raised socket whereby said large plate of thermal insulation functions to reduce heat conduction and reduce air infiltration through said outlet around the exterior edges of the faceplate and around the edges of the faceplate through which the socket passes;

(b) at least one non-electrically conductive dummy plug having a backing with blades adapted to fit into said receptacle slots, said dummy plug functions to prevent air infiltration through said slots, said dummy plug having a raised ridge around the edge of its backing to provide a recess in backing on the side of the backing containing the blades;

(c) at least one second small plate of thermal insulation adapted to fit removably over the front face of said receptacle socket, said small plate having slots through which the blades of said dummy plug may extend, said small plate of thermal insulation being sized to fit in and being positioned in said plug recess, said second plate also functions to reduce heat conduction and air infiltration through said outlet.

2. The outlet of claim 1, wherein said plates are comprised of a closed cell foam material.

3. The outlet of claim 2, wherein said closed cell foam has a low moisture vapor permeability, whereby moisture permeation through said outlet is also reduced.

* * * * *